US006972781B2

(12) United States Patent
Tytgat

(10) Patent No.: US 6,972,781 B2
(45) Date of Patent: Dec. 6, 2005

(54) THERMAL PRINTING METHOD

(75) Inventor: Bart Tytgat, Bonheiden (BE)

(73) Assignee: Agfa Gevaert N.V., Mortsel (BE)

( * ) Notice: Subject to any disclaimer, the term of this patent is extended or adjusted under 35 U.S.C. 154(b) by 51 days.

(21) Appl. No.: 10/610,283

(22) Filed: Jun. 30, 2003

(65) Prior Publication Data

US 2004/0004658 A1 Jan. 8, 2004

Related U.S. Application Data

(60) Provisional application No. 60/395,928, filed on Jul. 15, 2002.

(51) Int. Cl.[7] ..... B41J 2/315

(52) U.S. Cl. ..... 347/171

(58) Field of Search ..... 347/171, 172, 347/174, 176; 400/120.01, 120.02, 120.04; 378/98; 40/661, 706

(56) References Cited

U.S. PATENT DOCUMENTS

| | | | | |
|---|---|---|---|---|
| 2,841,903 | A * | 7/1958 | Christensen | 40/706 |
| 5,010,673 | A * | 4/1991 | Connor et al. | 40/661 |
| 5,585,830 | A * | 12/1996 | De Clerck et al. | 347/171 |
| 6,546,075 | B1 * | 4/2003 | Chartier et al. | 378/98 |

FOREIGN PATENT DOCUMENTS

| | | |
|---|---|---|
| EP | 0 679 523 A1 | 11/1995 |
| EP | 1 170 140 A1 | 1/2002 |
| EP | 02 10 0773 | 12/2002 |

* cited by examiner

*Primary Examiner*—K. Feggins
(74) *Attorney, Agent, or Firm*—John A. Merecki; Robert A. Sabourin

(57) ABSTRACT

A method of generating a hard copy of an image, i.e. a medical image on a substantially rectangular heat sensitive recording material having rounded corners wherein image pixels of the image are printed in a printable area within the area of said recording material, the printable area being defined by a polygon with a degree higher than 4 which approximates the area of the recording material.

3 Claims, 2 Drawing Sheets

THERMAL PRINTING METHOD

The application claims the benefit of U.S. provisional application No. 60/395,928 filed Jul. 15, 2002.

FIELD OF THE INVENTION

The present invention relates to hard copy recording of medical images.

BACKGROUND OF THE INVENTION

Nowadays several image acquisition systems exist that render medical images such as radiographic images in the form of digital signal representations.

An example of such an image acquisition system is a system based on temporary storage of the medical image such as a radiographic image on a photo-stimulable phosphor screen. A digital signal representation of the medical image is obtained by scanning a screen which has been exposed to a radiation image by means of stimulating radiation, detecting light emitted by the screen upon stimulation and converting the detected light into an electric signal representation.

Another example of such an image acquisition system is a so-called direct radiography system wherein a radiation image is recorded by a two-dimensional array of radiation sensitive elements that, upon addressing, render a digital signal representation of the radiation image.

Still other examples such as tomography acquisition system etc. may be envisaged.

For the purpose of diagnosis commonly a visible reproduction, either in the form of a hard copy or a soft copy is generated from a digital medical image.

To that end the digital signal representation of the medical image is applied to a hard copy recorder such as a thermal printer.

In case the diagnosis is performed on the hard copy image, the hard copy is attached to a viewing box for visual inspection and examination by the radiologist.

Hard copy images generated from a digital signal representation of an image commonly have a transparent boarder. This transparent boarder originates from the fact that hard copy recorders do often not print up to the outer edges of the recording material, i.a. because tolerances on the dimensions of the recording material, tolerances regarding transport and handling of the recording material in the printer etc. are taken into account.

Furthermore, recording materials used for reproduction of medical images commonly have rounded angles. Since the addressable area on a recording material is commonly defined in terms of a rectangular which fits into the area of the recording material, the distance from the edge of the recording material that is left transparent is also determined by the presence of these rounded angles.

When an image having a transparent boarder is attached to a viewing box for examination by the radiologist the dazzling light originating from the presence of transparent boarders on the hard copy may negatively affect the viewing conditions. Care has thus to be taken to minimise this effect.

A well known technique for avoiding the dazzling effect of the transparent boarders is the use of collimating curtains that are partially slided over the hard copy so to cover the transparent parts.

However, in the field of mammography, it is common practice to compare images of left and right breast by putting these images side by side on a viewing box.

In this case collimating curtains are not applicable to cover the area where the images are juxtaposed.

An alternative solution consists in providing an additional black boarder near to the transparent boarder in the boarder region of the image. The hard copies are then put in an overlapping position so that the transparent dazzling area of either of the films in the region between the two images is covered by the black boarder.

Hard copy recording systems exist that do not require the transparent boarder and that thus inherently solve the above-described problem originating from transparent boarders. An example of such a hard copy recorder is a laser recorder. Such systems are capable of printing across the boarder of the hard copy material so that no transparent boarder is created.

However, thermal printers do not have this ability.

Thermal printing is a recording process wherein images are generated by applying image-wise modulated thermal energy to a recording material. The applied heat brings about a visible change of optical density in a thermo-sensitive imaging material.

A particular interesting direct thermal recording material comprises a combination of an organic silver salt in combination with a reducing agent. A visible image may be created in such a material by applying image-wise modulated heat to the material which causes the silver ions to be developed into metallic silver.

The thermal heat is applied to the recording material by means of a print head which consists of a linear array of resistor elements. The recording material and the print head are transported relative to each other. Electric pulses corresponding with a digital image representation are applied to a thermal print head. The resistor elements convert the electrical energy into heat which is transferred to the recording material and generates a chemical reaction resulting in development of a visible image.

In case of thermal printers printing across the boarder of the hard copy material in order to avoid the creation of transparent boarders would result in melting of heat sensitive substance of the recording material at the boarder of the recording material. This melted substance would soil the print head and its surroundings resulting in dirty prints.

It is thus an aspect of the present invention to provide a method of thermal printing hard copy images on a recording material with rounded angles whereby the dazzling effect originating from clear boarder surrounding the image area is minimized.

SUMMARY OF THE INVENTION

The above-mentioned advantageous effects are realised by a method of generating a hard copy as set out in claim 1.

Specific features for preferred embodiments of the invention are set out in the dependent claims.

Further advantages and embodiments of the present invention will become apparent from the following description and drawings.

DETAILED DESCRIPTION OF THE INVENTION

Figure 1:
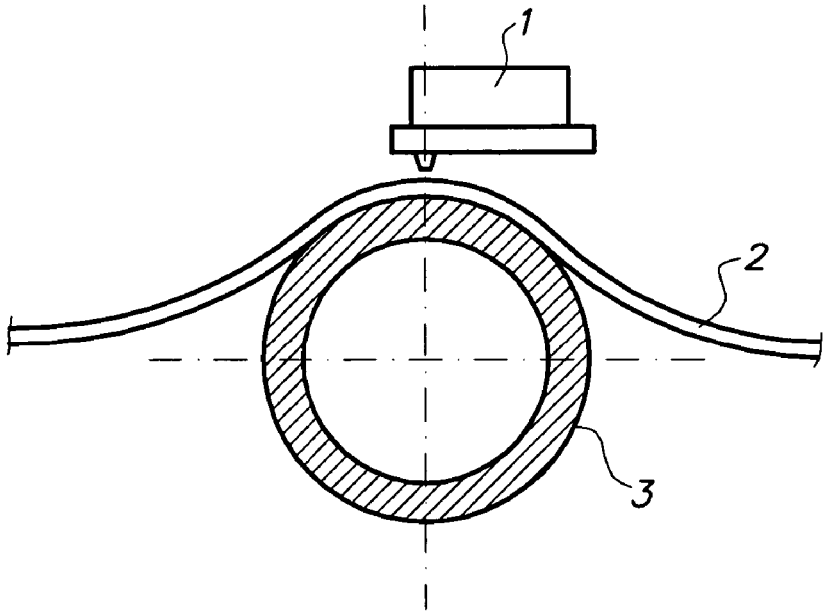
FIG. 1 is a schematic illustration of a thermal printer.

FIG. 1 shows the components of the thermal printer that are relevant in the context of the present invention.

The printer comprises a recording head 1 consisting of an array of juxtaposed resistor elements in a line-wise arrangement and associated electronic control and driver circuitry.

A recording material 2, which may be in sheet or web form, and the recording head 1 are transported relative to each other. In the illustrated example the recording material is secured to a driven rotatable drum 3 so that the recording material is advanced past the recording head 1.

The recording material in this example comprises a support coated with a thermo-sensitive layer containing an organic silver salt.

When being heated by the elements of the recording head the organic silver salt is locally reduced to metallic silver thereby producing a density that is proportional to the amount of energy transferred to the recording material at a specific location.

Energy is applied to each of the resistors under control of an electric signal. The amount of energy that is applied to an element of the recording head is controlled in accordance with the density to be reproduced by this element.

Figure 2:
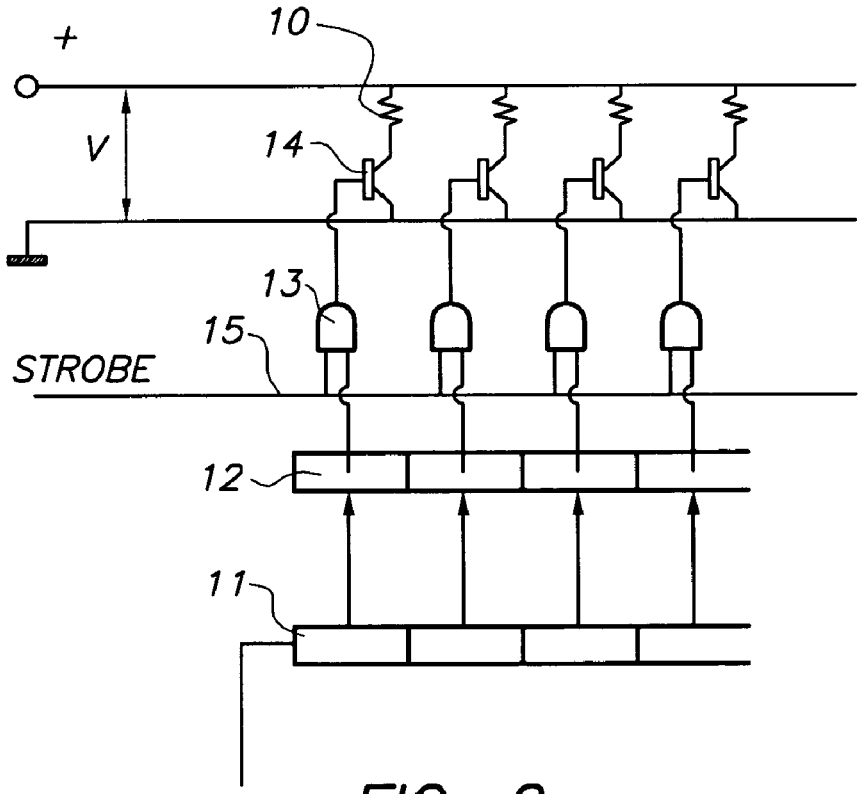
FIG. 2 is a scheme illustrating the data flow in a thermal printer.

An electronic scheme illustrating the composition of the recording head is shown in FIG. 2. The recording head of this thermal printer comprises 4992 individually energisable resistors (10) (at a resolution of 508 dots per inch).

This number of resistors is subdivided into a plurality of groups of a number of individual resistors. The head comprises a plurality of shift registers (11) each providing data signal values for a group of resistor elements.

The output of each of the registers is applied to a latch register (12).

The output of each element of the latch registers is connected to a corresponding gating means (13).

The output terminal of the gating means is connected to the electronic driver (14) of a resistor element of the recording head so that, under control of a strobe signal (15), the output of an element of the latch register can be gated to an individual element of the thermal recording head.

In the present embodiment digital values range from a value 0 to a value 8000. Minimal density is obtained when an element of the print head is energised by an amount of electric energy corresponding with the digital value 2000, maximum density is obtained when the print head is energised by an amount of energy corresponding with the value 8191. Values lower than 2000 result in transparency.

According to a specific implementation of the present invention for each film type and film dimension the printer has stored a description of the printable area within the total area of the film.

In accordance with the present invention this printable area is defined within the area of the recording material as a polygon with a degree higher than 4 which approximates the area of the recording material. For each vertex of the polygon the (x,y) coordinates are stored.

Preferably four edges of the polygon are parallel to the edges of said recording material and the remaining edges approximate the shape of said rounded corners.

An envelope imaginary rectangle can be drawn around this polygon.

For pixels within the area which originates from subtracting the area of the polygon from this rectangular area a digital value zero is applied to the print head resulting in a transparent area.

Within the printable area density values corresponding with image data are printed.

The higher the degree of the polygon, the better the rounded edges of the hard copy material will be approximated. However, an acceptable solution is already obtained by means of an octagon.

Figure 3:
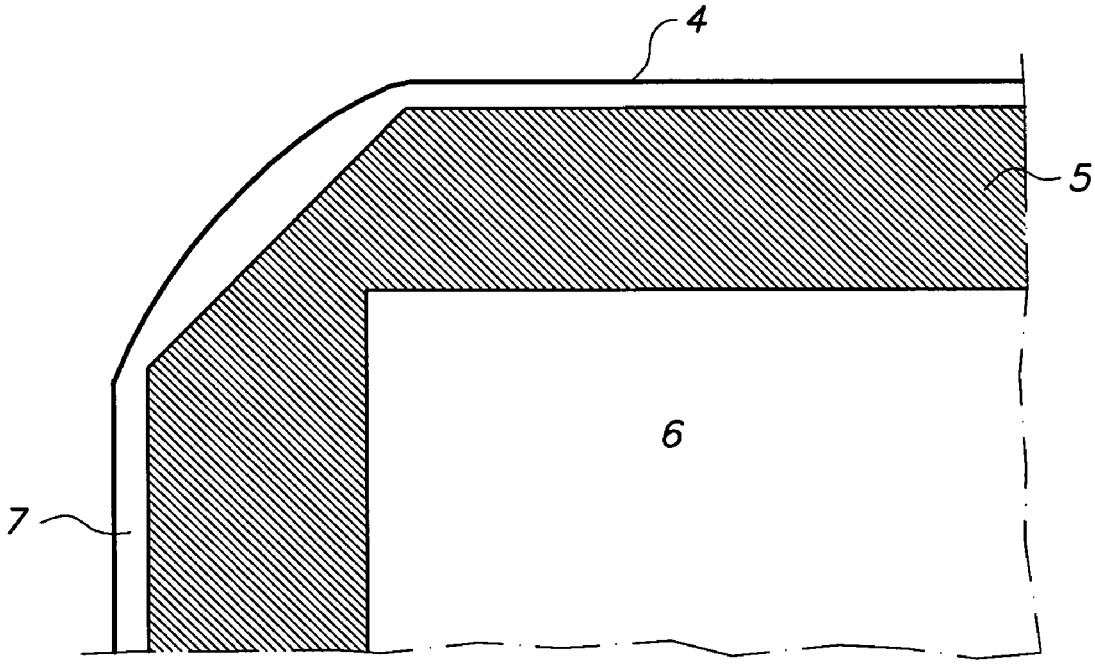
FIG. 3 illustrates the lay-out of the printable area on a recording material.

FIG. 3 shows an example of the lay out of the printable area on a recording material, the edge (4) of this material having rounded corners.

The printable area is defined by a polygon.

When printing a medical image, the area resulting from subtraction of the polygon area from a rectangle comprising the horizontal and vertical edges is left transparent.

In case of mammographic images the transparent boarder (7) situated at the thorax side of the mammography is kept as small as possible in order to be able to put a left and a right mammography close to each other on a viewing box.

In the embodiment shown the printable area within the polygon comprises in addition to the diagnostic area (6) a black border (5).

What is claimed is:

1. A thermal printing method of generating a hard copy of an image on a substantially rectangular heat sensitive recording material having rounded corners, the method comprising the steps of:

defining a printable area on the recording material that approximates dimensions of the recording material within a polygon having a degree higher than 4;

defining a transparent non-printable area of the recording material outside of the polygon shaped printable area; and printing image pixels of said image in the printable area.

2. A method according to claim 1 further defining the printable polygon area having four sides which are parallel to four edges of the recording material and remaining sides that approximate a shape of the rounded corners.

3. A method according to claim 1 wherein said polygon is an octagon.

* * * * *